US007147756B2

(12) United States Patent
Davenport

(10) Patent No.: US 7,147,756 B2
(45) Date of Patent: Dec. 12, 2006

(54) UNIQUE FABRIC STRUCTURE FOR INDUSTRIAL FABRICS

(75) Inventor: Francis L. Davenport, Ballston Lake, NY (US)

(73) Assignee: Albany International Corp., Albany, NY (US)

( * ) Notice: Subject to any disclaimer, the term of this patent is extended or adjusted under 35 U.S.C. 154(b) by 139 days.

(21) Appl. No.: 10/364,145

(22) Filed: Feb. 11, 2003

(65) Prior Publication Data

US 2004/0157045 A1 Aug. 12, 2004

(51) Int. Cl.
*B32B 7/04* (2006.01)
*B32B 37/00* (2006.01)
*D21F 7/12* (2006.01)

(52) U.S. Cl. ..... 162/358.2; 162/904; 428/37; 428/58; 428/193; 428/194; 156/195

(58) Field of Classification Search ..... 162/306, 162/348, 358.2, 358.4, 900–904, 116, 117, 162/381; 139/383 A, 425 A, 383 AA; 428/37, 428/57–60, 192–194; 156/184–195; 198/844.1
See application file for complete search history.

(56) References Cited

U.S. PATENT DOCUMENTS 3,097,413 A * 7/1963 Draper, Jr. ..... 34/95
5,208,087 A * 5/1993 Stigberg ..... 428/60
5,209,807 A 5/1993 Fry
5,268,076 A 12/1993 Best et al.
5,360,518 A 11/1994 McCarthy et al.
5,360,656 A * 11/1994 Rexfelt et al. ..... 428/193
5,713,399 A 2/1998 Collette et al.
5,785,818 A * 7/1998 Fekete et al. ..... 162/358.2
5,792,323 A 8/1998 Grondahl
5,837,080 A 11/1998 Grondahl
5,939,176 A 8/1999 Yook
5,968,318 A 10/1999 Hasegawa et al.
6,117,274 A 9/2000 Yook
6,124,015 A * 9/2000 Baker et al. ..... 428/99
6,162,518 A * 12/2000 Korfer ..... 428/60
6,240,608 B1 6/2001 Paquin et al.
6,265,048 B1 7/2001 Rydin et al.
6,331,341 B1 12/2001 Joyce
6,350,336 B1 * 2/2002 Paquin ..... 156/93
6,358,369 B1 3/2002 Yoshida et al.
6,565,713 B1 * 5/2003 Hansen et al. ..... 162/358.2
6,811,849 B1 * 11/2004 Best ..... 428/58
2001/0027593 A1 10/2001 Paquin et al.
2002/0104631 A1 8/2002 Hansen et al.

* cited by examiner

*Primary Examiner*—Eric Hug
(74) *Attorney, Agent, or Firm*—Frommer Lawrence & Haug LLP; Ronald R. Santucci

(57) ABSTRACT

An industrial process fabric and a method for manufacturing such a fabric. The fabric is made of material and is endless, or made endless with a seam, in the machine direction of a machine on which it is used. The fabric comprises at least one layer composed of a spirally-wound strip made of material and having a width which is smaller than the width of the final fabric. The longitudinal axis of the spirally-wound strip of material makes an angle with the machine direction of the fabric. The fabric strip of material may advantageously be a flat-woven fabric of MD and CD yarns in any weave pattern.

16 Claims, 3 Drawing Sheets

FIG. 4
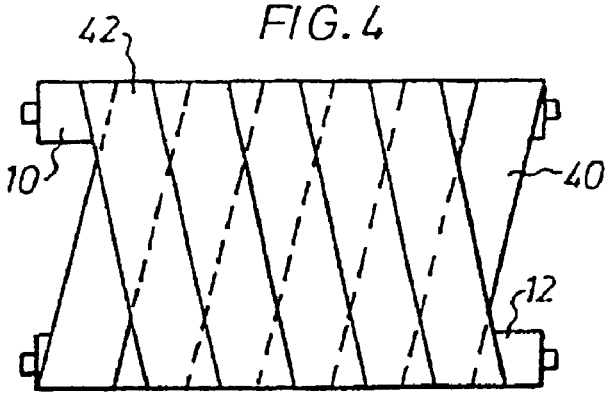
FIG. 5
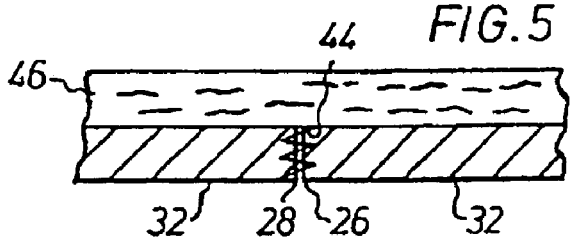
FIG. 6
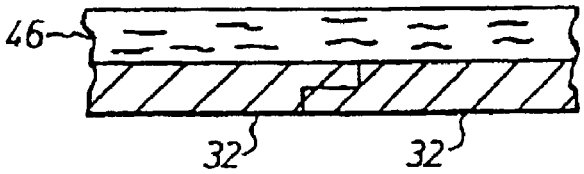
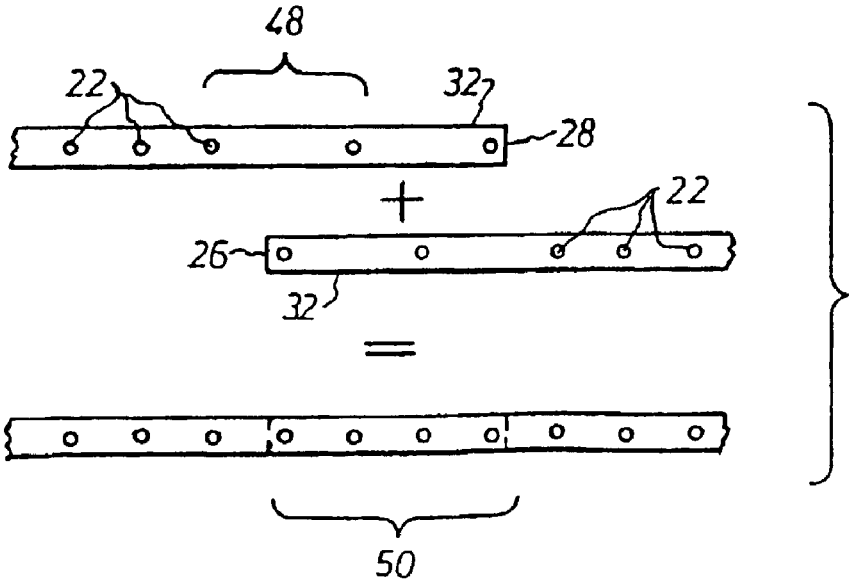
FIG. 7

UNIQUE FABRIC STRUCTURE FOR INDUSTRIAL FABRICS

BACKGROUND OF THE INVENTION

The present invention relates to industrial fabrics, and to a method of manufacturing industrial fabrics.

The term "endless fabric" as used herein and in the following relates to a fabric which is closed during operation. The term "endless" should, in particular, be considered also to include the case where the fabric can be opened across the machine direction for mounting in an industrial process machine, and subsequently joined together by means of a locking seam.

The "fabric of yarn material" as used herein may in particular be some type of woven, knitted, arrays of MD or CD yarns or other nonwoven structures such as extruded meshes, and the term "fiber material" includes all types of batt layers and the like that can be used in an industrial process fabric.

Currently, some fabrics for industrial process applications, such as in the production of nonwovens by processes such as spin bonding or hydroentangling; or corrugator belts used in the production of corrugated boxboard, are manufactured mainly by a tubular weaving technique which is known to those skilled in the art and according to which the fabric is made in the form of a tube and the weft threads are alternately passing into an upper warp thread layer (upper cloth) and a lower warp thread layer (lower cloth). The extent of this "tube" in the transverse direction of the weaving loom thus corresponds to half the length of the final fabric. The width of the fabric is determined by the weaving length.

This known technique suffers from several shortcomings. For one, the length of a tubular-woven fabric is determined by the reed width in the weaving loom. A tubular-woven fabric thus has a given length which cannot be substantially modified afterwards and which therefore, during the very weaving operation, must be adjusted to precisely the machine in which the fabric is to be mounted. Hence, the fabric cannot be manufactured and kept in stock in large series, but must be manufactured to a specific order. This extends the delivery time and means low degree of utilization of the weaving equipment. Moreover, the weaving looms must be given a considerable width, preferably over 20 m to permit tubular weaving of all current lengths of fabric. The weaving looms therefore become both large and expensive.

Other fabrics are flat woven. That is, they are a flat woven, continuous band of material of warp (MD) and weft (CD) yarns. These bands are woven to a width that is approximately the width of the final end use fabric structure. The length required is formed by cutting from the band a length in excess of the required final fabric length. The two CD edges of the band are then prepared in one of the following manners: MD and CD yarns are interwoven from each end to join the fabric into a continuous loop or tube of the required length; warp yarns are woven back into the respective each end of the strip with a small loop formed. These loops on each end are then interdigitated and a pin or pintle is passed through them forming a seam. Or a set of metal clipper hooks can be embedded into each end of the fabric, the closed end of the "hook" having a protruding loop. Again these loops are interdigitated and a pin or pintle passed through them to connect the full width seam. Other methods can be used to join the two ends of the fabric together as known to those skilled in the art.

The need to weave the support structure to a width at least as great as the width required for the final fabric requires weaving looms greater than 160 inches (4 meters) up to approximately 560 inches (14 meters).

Seaming can also be an expensive and time consuming step. Also, the need for a seam often limits the weave pattern or number and size of the warp yarns in the body of the fabric below an optimum level for best fabric performance.

Furthermore, the design of many industrial process machines dictates that the fabrics/belts they use be seamable on the machine.

Accordingly, there is a current need to provide an efficient seamable industrial process fabric and a cost effective method for producing such a fabric.

SUMMARY OF THE INVENTION

An industrial process fabric according to the invention thus comprises an endless fabric of yarn material. The novel features of the invention reside in that the fabric comprises at least one layer composed of a spirally-wound fabric strip made of yarn material and having a width which is less than the width of the final fabric. The fabric strip of yarn material, preferably being a flat-woven strip, has longitudinal threads which in the final fabric make an angle with the machine direction of the fabric.

During the manufacture of the fabric, the fabric strip of yarn material is wound or placed spirally, preferably over at least two rolls having parallel axes, to form said layer of the fabric. Thus, the length of fabric will be determined by the length of each spiral turn of the fabric strip of yarn material and its width determined by the number of spiral turns.

The number of spiral turns over the total width of the fabric may vary. The term "strip" as used herein and in the following relates to a piece of material having an essentially larger length than width, the only upper limit of the strip width is that it should be narrower than the width of the final fabric. The strip width may for example be 0.5–1.5 m, which should be compared with, for example, a conveying fabric for a hydroentangling machine which may be wider than 4.0 m.

To achieve a smooth finished fabric, adjoining portions of the longitudinal edges of the spirally-wound strip are preferably so arranged that the joints or transitions between the spiral turns become completely smooth, i.e. such that the spirally-wound layer has a substantially constant thickness across the entire width of the fabric.

The spiral turns of the strip need not necessarily be fixed to each other, but preferably there is an edge joint between the adjoining longitudinal edge portions of the spirally-wound strip. The edge joint can be achieved, e.g. by sewing (for instance with water-soluble thread), melting, and welding (for instance ultrasonic welding), of non-woven material, or of non-woven material with melting fibers. The edge joint can also be obtained by providing the fabric strip of yarn material along its two longitudinal edges with seam loops of known type, which can be joined by means of one or more seam threads. Such seam loops may for instance be formed directly of the weft threads, if the strip is flat-woven.

To achieve the smooth transition between the spiral turns, these may be arranged edge to edge or overlappingly. In the latter case, the strip edges must however be so shaped that when being placed so as to overlap each other, they fit into each other without giving rise to any thickness increase at the joint. One way of achieving this is to reduce the thickness of the edges by half as compared with the thickness of the rest of the strip. Another way is to increase the warp thread spacing at the edges and "interlace" the overlapping edges, as will be described in more detail hereinbelow.

According to an embodiment of the invention of particular interest, two or more spirally-wound layers of the above-mentioned type are provided, and of special interest is an embodiment in which the spiral turns in the different layers are placed crosswise, i.e. such that the longitudinal threads of the strip in one layer make an angle both with the machine direction of the fabric and with the longitudinal threads of the strip in another layer.

Other preferred embodiments and features of the invention are recited in the dependent claims.

The invention provides the following advantages:

The weaving loom can be considerably limited in width, e.g. to 0.5–1.5 m, giving low investment costs. Since these looms also weave faster (higher number of yarns woven per unit time), productivity is also increased.

The fabric strip of yarn material, especially a flat-woven one, can be manufactured and kept in stock in considerable lengths (e.g. thousands of meters) before being dispensed from a supply reel and placed spirally into the desired length and width of the fabric, which spiral arrangement can be achieved in a very short time, e.g. in one day or less. Thus, the delivery time is considerably cut.

It is easier to maintain a uniform quality (tension, yarn spacing) over a small strip width, e.g. 0.5–1.5 m, than over the relatively larger width (e.g. 4–14 m) normally used, resulting in a higher quality to the fabric layer built up of the strip of yarn material.

If two or more layers spirally arranged crosswise are used, particularly interesting advantages are gained. Layers of the structure will not "nest" or collapse into each other. Simple weave patterns can be used to build up the required fabric thickness or void volume. For example, common corrugator belt base support structures are an integrally woven four layer design. Four layers of a simple single layer weave, spirally wound as in the present invention, will result in a satisfactory base support structure.

If required, batt fiber can be applied to the support structure(s) which will both hold the layers together and provide the required surface and permeability characteristics of a belt for a corrugator machine.

As stated, many industrial process applications require an on machine seamable fabric. This can be done with this inventive structure by a variety of methods, some disclosed above. Also, methods as taught in U.S. Pat. No. 5,939,176 and patent application Ser. No. 10/159,926 can be employed and are herein incorporated by reference.

BRIEF DESCRIPTION OF THE DRAWINGS

The invention will now be described in more detail hereinbelow in some embodiments with reference to the accompanying drawings, in which

FIG. 4 is a highly simplified top plan view illustrating a method of manufacturing a multilayer fabric according to the invention.

FIG. 5 is an enlarged schematic view of an edge joint between spiral turns of an industrial fabric according to the invention.

FIG. 6 shows a variant of the embodiment in FIG. 5, and

FIG. 7 shows another variant of the embodiment in FIG. 5.

DESCRIPTION OF THE PREFERRED EMBODIMENTS

Figure 1:
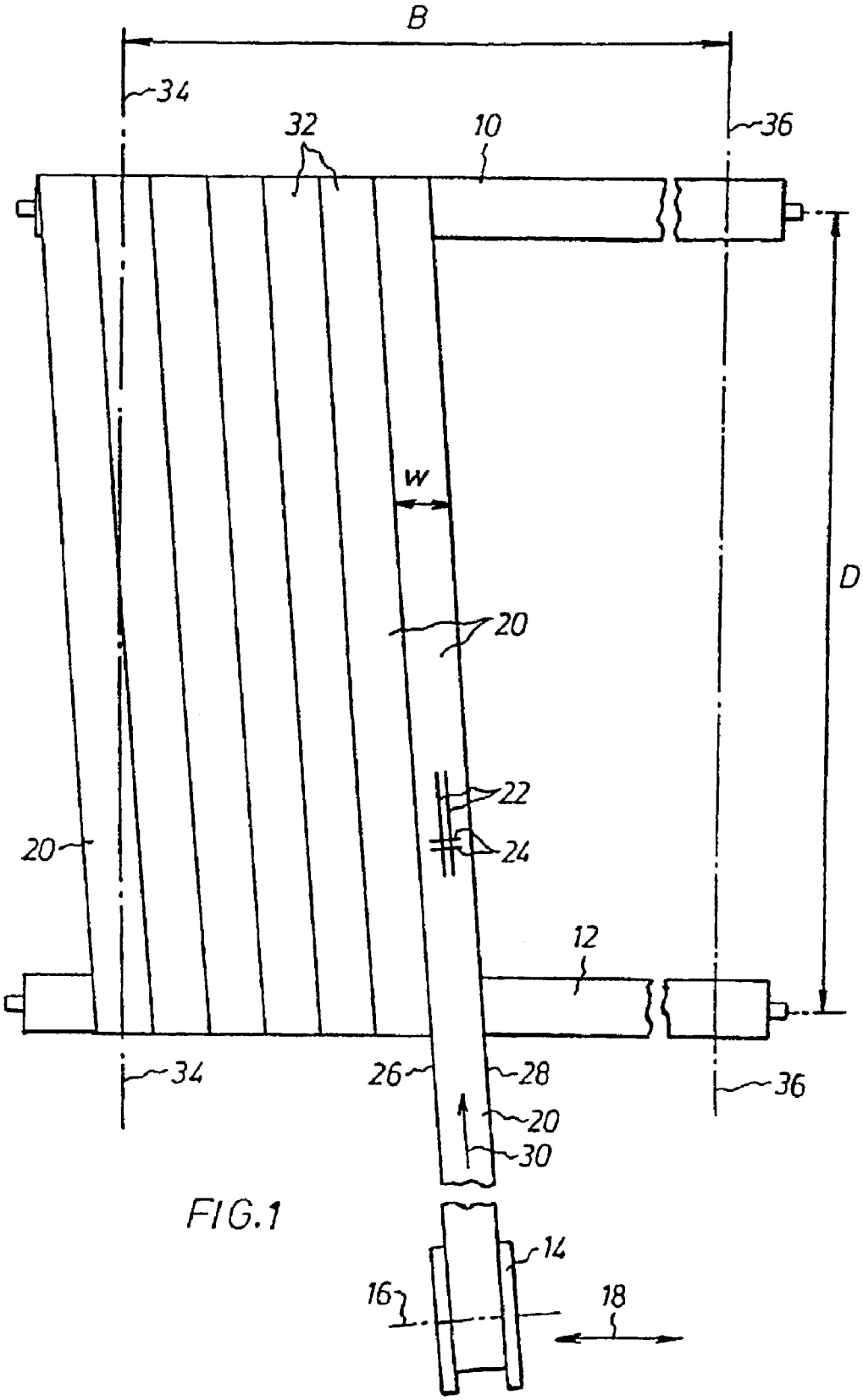
FIG. 1 is a schematic top plan view illustrating a method of manufacturing a fabric according to the invention.
Figure 2:
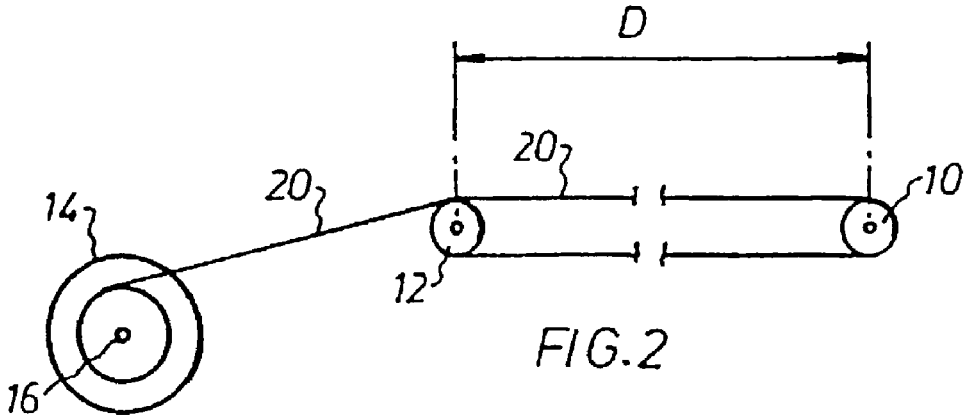
FIG. 2 is a side view corresponding to FIG. 1.

FIGS. 1 and 2, to which reference is now made, illustrate two rotatably mounted rolls 10, 12 having parallel axes spaced from each other by a distance D equivalent to approximately two times the desired fabric length for an "endless" fabric. At the side of one roll 12, there is provided a supply reel 14 rotatably mounted about an axis 16 and displaceable parallel to the rolls 10 and 12, as indicated by the double arrow 18.

The supply reel 14 accommodates a reeled supply of for example a flat-woven fabric strip of yarn material 20 having a width w. The flat-woven strip 20 has in known manner two mutually orthogonal thread systems consisting of longitudinal threads (warp threads) and cross threads (weft threads) schematically represented in FIG. 1 at 22 and 24, respectively. Further, the strip 20 has two longitudinal edges 26 and 28, the edges of which are e.g. uniformly cut to a desired width before the strip 20 is wound on to the supply reel 14.

The supply reel 14 is initially applied at the left-hand end of the roll 12 before being continuously displaced to the right at a synchronized speed. As the supply reel 14 is displaced sideways, the strip 20 is dispensed, as indicated by an arrow 30, to be wound spirally about the rolls 10, 12 into a "tube" having a closed circumferential surface. The strip 20 is placed around the rolls 10, 12 with a certain pitch angle, which in the illustrated embodiment is assumed to be so adapted to the strip width w, the distance D between the roll axes and the diameters of the rolls 10, 12, that the longitudinal edges 26, 28 of adjacent "spiral turns" 32 are placed edge to edge (see FIG. 5), so as to provide a smooth transition between the spiral turns 32.

The number of spiral turns 32 placed on the rolls 10, 12 is dependent on the desired width B on the final fabric. After the spiral winding operation is completed, the edges of the resulting fabric are cut along the dash-dot lines 34, 36 in FIG. 1 to obtain the width B. The length of the final fabric essentially is twice the distance D for an endless and some seamed fabrics between the roll axes and can therefore easily be varied by changing the distance D.

To prevent the spiral turns 32 already wound on the rolls 10, 12 from shifting on the rolls, it is possible, if so required, for instance to fix the first turn 32 in the longitudinal direction of the rolls.

Figure 3:
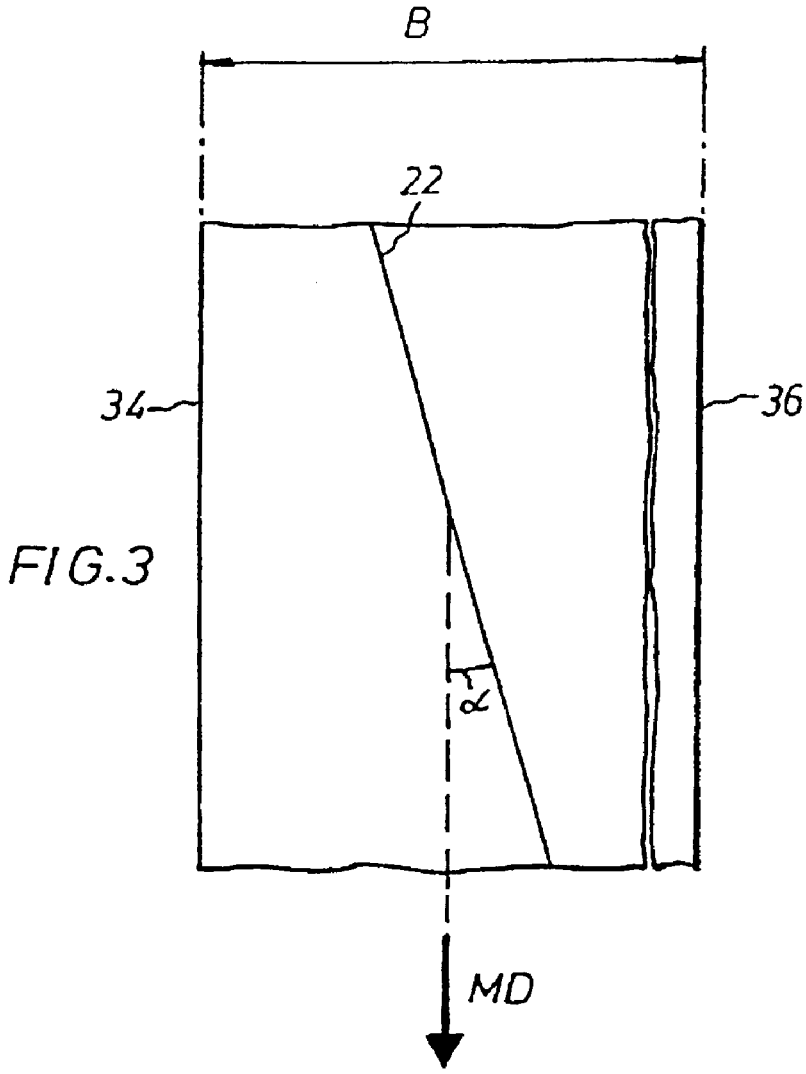
FIG. 3 shows on an enlarged scale a broken-away part of a fabric made according to FIGS. 1 and 2 and schematically illustrates an angular relation between longitudinal threads in the fabric.

FIG. 3, to which reference is now made, shows on an enlarged scale a broken-away part of a fabric produced as shown in FIGS. 1 and 2. Each longitudinal thread (warp thread) 22 of the strip 20 makes an angle $\alpha$ with the machine direction MD of the fabric. These oblique longitudinal threads 22 run uninterrupted through the entire fabric layer, whilst the cross threads (weft threads) 24 are interrupted and each have a length w. This is contrary to a traditional tubular-woven endless fabric, in which the longitudinal threads (which in a tubular-woven fabric consist of the weft threads) are parallel to the machine direction and the cross threads (warp threads) run uninterrupted across the entire width of the fabric.

FIG. 4 illustrates most schematically, with an exaggerated small distance between the rolls 10, 12 and with an exaggerated large strip width w, an inventive embodiment of particular interest. Two spirally-wound layers 40 and 42 are placed crosswise on each other, optionally setting out from one and the same strip 20. As mentioned above, this embodiment especially yields the advantage of a multilayer fabric wherein the layers will not "nest" or collapse into each other, thus maintaining desired fabric properties since the longitudinal threads in both layers 40, 42 make an angle with each other. For an embodiment according to FIG. 4, it may be possible in some cases to dispense with the above-mentioned edge joint. That is, in an embodiment according to FIG. 4, the "spiral turns" of each layer my be held in adjacent positions by the fixing of the layers to one another (e.g. through application of a batt fiber).

As a variant of the embodiment in FIG. 4, it is also possible to combine a spirally-wound layer of fabric according to the invention with a traditionally tubular-woven layer of fabric to form a fabric of multi-layer type. Also any combination of structures formed by spiral winding strips of material is possible depending upon the requirement of the final structure's end use.

For a fabric of multilayer type, it is further possible in known manner to use different thread spacings/structures for the different layers in order to obtain, for example, special dewatering-enhancing properties.

FIG. 5 schematically shows how the end edges 26, 28 of two juxtaposed spiral turns 32 are in edge-to-edge relationship and joined by sewing, as schematically indicated at 44. FIG. 5 also schematically illustrates a top layer 46 of fiber material, such as a batt layer, arranged on the fabric, e.g. by needling.

As to the top layer 46 and the needling thereof, it may be mentioned in particular that the top layer can be used for holding together the different layers in a fabric of multilayer type according to FIG. 4.

FIG. 6 shows an alternative embodiment according to which adjacent longitudinal edge portions of adjoining spiral turns are arranged overlappingly, the edges having a reduced thickness so as not to give rise to an increased thickness in the area of transition.

FIG. 7 shows another variant with overlapping of adjoining edge portions. According to this alternative, the spacing between longitudinal threads is increased at the edges 26, 28 of the strip 20, as indicated at 48, and the longitudinal threads 22 of the edge portions are interlaced. The result is an unchanged spacing between longitudinal threads in the area of transition, as indicated at 50.

Multiple layers, each formed in the same manner as the fabric in FIG. 1, can be combined to form useful industrial fabrics. For example, 2, 3 or 4 of such layers can be formed and joined to form a corrugator belt structure, each layer being either a single layer or multi-layer weave. Proper selection of yarns in the substrate will be used as applicable for a corrugator belt. Batt fiber can be applied to this base support, and during the finishing process, the batt can be cut through and various methods can be employed to form a seam to join the structure's ends together or to produce a "hooded pin seam." Expensive weaving time can be reduced, and a more open fabric can be produced as compared to fabrics produced using conventional corrugator belt manufacturing processes.

For a "belt filter press," a single layer spirally made like that of FIG. 1 can be used. This single layer of fabric can be a multi-layer design similar to a multi layer weave fabric that is flat woven and joined into endless form today. Successful manufacture using this inventive technique will reduce weaving cost, and expensive joining costs. The fabric can be installed in an endless fashion.

In general, experience in each application of the invention will determine whether one or more layers of spiraled fabric are required. Then, proper weave selection and yarn types will be determined, and in turn, one or more layers are formed using the disclosed spiral technique to produce a product.

In any event, several methods may be used to join the adjacent turns of spiraled material to each other, as well as each layer of material to each other, including the use of ultrasound to bond selective points, adhesives/glues or low melts. Of particular interest is the ultrasonic bonding discussed in U.S. Pat. No. 5,713,399, herein incorporated by reference. One of ordinary skill in the art of the invention could readily apply the bonding taught in U.S. Pat. No. 5,713,399 to the present invention when such bonding is considered in light of this disclosure. The use of a low melt sheath between the fabric layers as well as needling batt fiber through are suggested methods to "laminate" layers together. When employing the "sheath technique," the layers and sheath (or "laminate") can be exposed to heat with or without pressure to bond the layers together.

Another laminating technique suitable for the invention is the use of bondable yarns. Such yarns may be used in only the MD direction, in only the CD direction, or in both the MD and CD directions. For example, polyurethane coated yarns could be used, like the yarns disclosed in U.S. Pat. No. 5,360,518, herein incorporated by reference. Then, after producing the proper number of layers of fabric, the composite is exposed to heat with or without pressure to bond it together.

Lastly, a laminated structure can be formed by spiraling together a structure that itself is a laminate. In this regard, one of ordinary skill in the art of the invention could readily apply the teachings of the U.S. patent application Ser. No. 776.049, herein incorporated by reference, and U.S. patent application Ser. No. 679,697, herein incorporated by reference, to the present invention when such teachings are considered in light of this disclosure.

While the present invention has been particularly shown and described in conjunction with preferred embodiments thereof, it will be readily appreciated by those of ordinary skill in the art that various changes may be made without departing from the spirit and scope of the invention. Therefore, it is intended that the appended claims be interpreted as including the embodiments described herein as well as all equivalents thereto.

What is claimed is:

1. An industrial process fabric, which is endless or made endless with a seam, in a machine direction of the fabric, comprising at least two layers joined to each other, each layer being made up of a plurality of spiral turns formed by a spirally-wound material strip, said strip having a width which is smaller than a width of the fabric, the longitudinal axis of the spiral turns making an angle with said machine direction of the fabric, wherein said at least two layers and said turns are bonded or joined to one another by at least one bonding technique selected from the group consisting of ultrasonic bonding, adhesive bonding, bonding through a low melt material and bonding through the use of bondable yarns.

2. An industrial process fabric as claimed in claim 1, wherein for at least one of said layers said material strip is a flat-woven strip of MD and CD yarns, knitted material, a nonwoven mesh, or an array of MD or CD yarns.

3. An industrial process fabric as claimed in claim 1, wherein for at least one of said layers adjacent longitudinal edge portions of the spirally-wound material strip are so arranged that said layer has a substantially constant thickness over the entire width of the fabric.

4. An industrial process fabric as claimed in claim 3, wherein said adjacent longitudinal edge portions of the spirally-wound material strip are arranged edge to edge.

5. An industrial process fabric as claimed in claim 3, wherein said adjacent longitudinal edge portions of the spirally-wound material strip are overlapping.

6. An industrial process fabric as claimed in claim 1, wherein at least one of said layers of spiral turns further comprises an edge joint provided between adjacent longitudinal edge portions of the spirally-wound material strip.

7. An industrial process fabric as claimed in claim 6, wherein said adjacent longitudinal edge portions of the spirally-wound material strip are sewn, ultrasonically bonded, or glued together for providing said edge joint.

8. An industrial process fabric as claimed in claim 1, wherein for at least one of said layers said material strip is a laminate.

9. A method for forming an industrial process fabric, which is endless or made endless with a seam, in a machine direction of the fabric, comprising the steps of:

providing at least two layers, each layer including a plurality of spiral turns, and each layer being formed by spirally winding a material strip, said strip having a width which is smaller than a width of the fabric, the longitudinal axis of the spiral turns making an angle with said machine direction of the fabric; and joining or bonding said at least two layers and said spiral turns to one another by at least one bonding technique selected from the group consisting of ultrasonic bonding, adhesive bonding, bonding through a low melt material and bonding through the use of bondable yarns.

10. A method as claimed in claim 9, wherein for at least one of said layers said material strip is a flat-woven strip of MD and CD yarns, knitted material, a nonwoven mesh, or an array of MD or CD yarns.

11. A method as claimed in claim 9, wherein for at least one of said layers adjacent longitudinal edge portions of the spirally-wound material strip are so arranged that said layer has a substantially constant thickness over the entire width of the fabric.

12. A method as claimed in claim 11, wherein said adjacent longitudinal edge portions of the spirally-wound material strip are arranged edge to edge.

13. A method as claimed in claim 11, wherein said adjacent longitudinal edge portions of the spirally-wound material strip are overlapping.

14. A method as claimed in claim 9, wherein said step forming at least two layers includes forming an edge joint between adjacent longitudinal edge portions of the spirally-wound material strip for at least one of said two layers.

15. A method as claimed in claim 14, wherein said adjacent longitudinal edge portions of the spirally-wound material strip are sewn, ultrasonically bonded, or glued together for providing said edge joint.

16. An industrial process fabric as claimed in claim 9, wherein for at least one of said layers said material strip is a laminate.

* * * * *